US005226395A

United States Patent [19]

Krebs et al.

[11] Patent Number: 5,226,395

[45] Date of Patent: Jul. 13, 1993

[54] METHOD FOR CONTROLLING AN INTERNAL COMBUSTION ENGINE

[75] Inventors: Stefan Krebs; Erwin Achleitner, both of Regensburg, Fed. Rep. of Germany

[73] Assignee: Siemens Aktiengesellschaft, Munich, Fed. Rep. of Germany

[21] Appl. No.: 820,352

[22] Filed: Jan. 14, 1992

[51] Int. Cl.[5] ..... F02D 41/34

[52] U.S. Cl. ..... 123/486; 123/488

[58] Field of Search ..... 123/478, 480, 486, 488, 123/494

[56] References Cited

U.S. PATENT DOCUMENTS

| | | | |
|---|---|---|---|
| 3,964,443 | 6/1976 | Hartford | 123/416 |
| 4,462,375 | 7/1984 | Isobe et al. | 123/488 |
| 4,465,051 | 8/1984 | Hasegawa | 123/478 |
| 4,495,925 | 1/1985 | Hasegawa | 123/480 |
| 4,711,217 | 12/1987 | Kano et al. | 123/486 |
| 4,815,435 | 3/1989 | Lefevre et al. | 123/494 |
| 4,823,755 | 4/1989 | Hirose et al. | 123/480 |
| 4,886,027 | 12/1989 | Orrell et al. | 123/478 |

FOREIGN PATENT DOCUMENTS

| | | |
|---|---|---|
| 0326065 | 8/1989 | European Pat. Off. . |
| 3714245 | 11/1987 | Fed. Rep. of Germany . |
| 3802211 | 8/1988 | Fed. Rep. of Germany . |
| 61-031646 | 2/1986 | Japan . |
| 62-258139 | 11/1987 | Japan . |
| 2046950 | 11/1980 | United Kingdom . |

OTHER PUBLICATIONS

Publication Motronic, Jan. 1983, pp. 24/25.

*Primary Examiner*—Andrew M. Dolinar

*Attorney, Agent, or Firm*—Herbert L. Lerner; Laurence A. Greenberg

[57] ABSTRACT

A defect of prior art methods for controlling an internal combustion engine based on families of characteristics depending on pressure and rpm is that an air mass being taken in is a function of an air temperature in a cylinder and thus of heating in an intake section. This defect is corrected according to the invention by multiplying a basic fuel value taken from a basic family of characteristics by a factor having a denominator containing a correction temperature being determinative for heating-up the intake air in the intake section as a function of its temperature and of an air flow and being taken from a corresponding family of temperature characteristics.

9 Claims, 1 Drawing Sheet

METHOD FOR CONTROLLING AN INTERNAL COMBUSTION ENGINE

CROSS-REFERENCE TO RELATED APPLICATION

Figure 1:
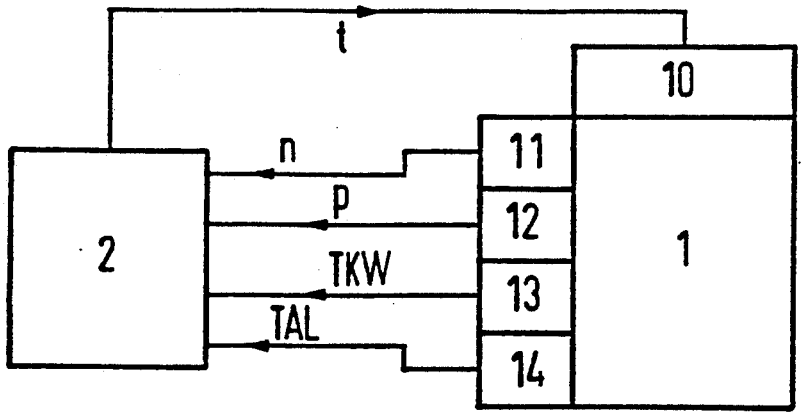

This application is a Continuation of International Application PCT/EP90/01098, filed Jul. 6, 1990.

The invention relates to a method for controlling an internal combustion engine, in which a fuel mass to be injected into each cylinder for each cycle in dependence on operating parameters of the internal combustion engine, is determined by reading a basic fuel value out of a basic family of characteristics or a characteristic diagram and the basic fuel value is corrected as a function of the temperature of the intake air, and the basic fuel value is multiplied by a correction factor FK in the form of a quotient $$FK = A/B$$

in which the denominator B is a temperature value.

Such a method in which, however, the temperature value in the denominator of the correction factor is only dependent on the temperature of the intake air, is known from U.S. Pat. No. 4,495,925.

It has been found that the accuracy of the precontrol which can be achieved in such a way is no longer adequate for current requirements.

It is accordingly an object of the invention to provide a method for controlling an internal combustion engine, which overcomes the hereinafore-mentioned disadvantages of the heretofore-known methods of this general type and which does so in such a manner that, as a result, the precontrol is more accurate. The invention is based on the finding that the density of the air in the cylinder, and thus the air mass per stroke and the fuel mass to be metered, is not adequately described by the temperature of the intake air. Instead, the temperature of the intake air is increased inside the intake section by additional heating-up, with this heating-up being dependent on the load condition of the internal combustion engine.

With the foregoing and other objects in view there is provided, in accordance with the invention, in a method for controlling an internal combustion engine having cylinders operating in cycles and an intake tube for intake air, which includes determining a fuel mass to be injected into each cylinder for each cycle by reading a basic fuel value out of a basic family of characteristics as a function of operating parameters of the internal combustion engine and correcting the basic fuel value as a function of a temperature of the intake air, and multiplying the basic fuel value by a correction factor in the form of a quotient FK=A/B, wherein the denominator B is a temperature value, the improvement which comprises selecting the variables of the basic family of characteristics as a pressure in the intake tube and an rpm, and reading a correction temperature contained in the temperature value out of a family of temperature characteristics, in particular independently of a variable dependent on an air flow and of a heating temperature being determinative for heating up the intake air in the intake section.

According to the invention, the temperature value in the denominator of the quotient is therefore read out of a family of temperature characteristics, in particular as a function of a heating temperature and the air flow, that is to say as a function of parameters which represent the load condition of the internal combustion engine.

In accordance with another mode of the invention, there is provided a method which comprises adding the respective temperature of the intake air to the correction temperature read out of the family of temperature characteristics for determining the denominator B in the correction factor FK.

In this context, the heating temperature is the difference between the temperature of the intake air and a temperature value which describes the respective thermal condition of the internal combustion engine, in particular of its intake section, and which is determinative for the heating-up of the intake air in the intake section. For this purpose, for example, the temperature can be interrogated or inquired into at a representative point in the intake section.

However, in accordance with a further mode of the invention, there is provided a method which comprises using the difference between the cooling water temperature, which is sensed in any case, and the intake air temperature, as the heating temperature.

In accordance with an added mode of the invention, there is provided a method which comprises using the product of the respective speed of rotation or rpm of the internal combustion engine and the respective basic fuel value as a measure of the air flow. This is done since the basic fuel value is, of course, proportional to the air flow in accordance with the prerequisites (stoichiometric mixing ratio).

In accordance with an additional mode of the invention, there is provided a method which comprises determining the family of temperature characteristics by calculating a mathematical value of a corrected intake air temperature for each interpolation point of the heating temperature and for each interpolation point of the air flow, in accordance with the formula $$TALK = \frac{p \times VZ}{LM \times R}$$

then subtracting the respective temperature of the intake air TAL from this value, and entering the result as correction temperature TK at the interpolation point of the family of temperature characteristics.

In accordance with a concomitant mode of the invention, there is provided a method which comprises determining the basic family of characteristics for a particular internal combustion engine on a test bed, with the internal combustion engine being operated by means of a control device which calculates the fuel mass supplied for each cylinder and stroke in accordance with the invention, by using the previously determined family of temperature characteristics; using design conditions (a selected cooling water temperature and intake air temperature) to set the speed of rotation or rpm and intake pressure variables for the individual interpolation points of the basic family of characteristics and changing the associated basic fuel value until the desired value is obtained, as a rule in accordance with the stoichiometric mixing ratio between fuel and air; and then entering the basic fuel value thus obtained into the basic family of characteristics. The fuel mass actually being injected deviates from this basic fuel value in accordance with the correction according to the invention.

The basic family of characteristics therefore contains "corrected" values which apply to the selected cooling water temperature and intake air temperature from which influences of different heating temperatures have thus been eliminated. Since the basic family of characteristics is determined at constant heating temperature, that is to say constant temperature of the cooling water and of the intake air, a single characteristic of the family of temperature characteristics is sufficient for this purpose.

Other features which are considered as characteristic for the invention are set forth in the appended claims.

Although the invention is illustrated and described herein as embodied in a method for controlling an internal combustion engine, it is nevertheless not intended to be limited to the details shown, since various modifications may be made therein without departing from the spirit of the invention and within the scope and range of equivalents of the claims.

The method of operation of the invention, however, together with additional objects and advantages thereof will be best understood from the following description of specific embodiments when read in connection with the accompanying drawings.

Figure 2:
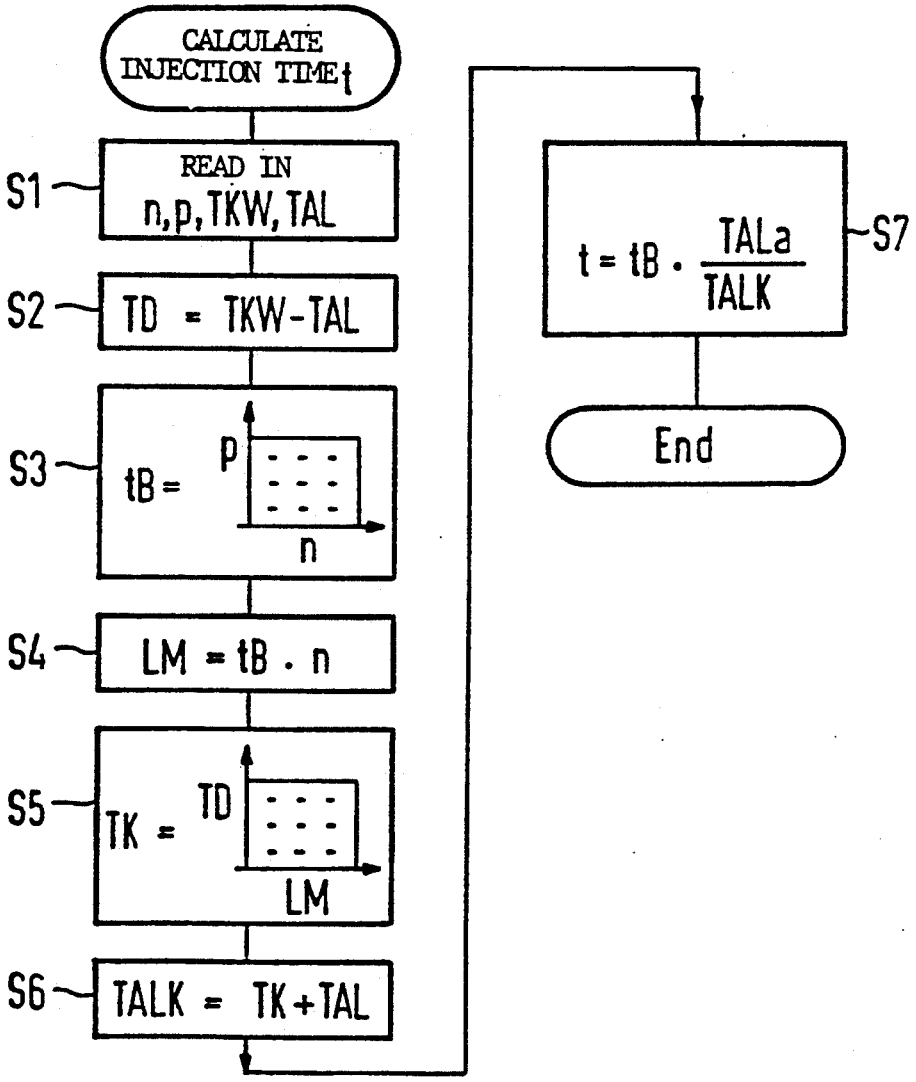

FIG. 1 is a block diagram of an injection system of an internal combustion engine in which the method according to the invention is used; and FIG. 2 is a flow chart for carrying out the method.

Referring now to the figures of the drawing in detail and first, particularly, to FIG. 1 thereof, there is seen an internal combustion engine 1 which is provided with a speed-of-rotation or rpm sensor 11, a pressure sensor 12 for a suction tube pressure, a cooling water temperature sensor 13 and an intake air temperature sensor 14. Initial values of these sensors, namely a speed of rotation or rpm n, a suction tube pressure p, a cooling water temperature TKW and an intake air temperature TAL, are supplied as input quantities to a control device 2. From these values, the control device 2 determines an injection time t for injection valves 10 of the internal combustion engine 1, by means of which an injected fuel mass is determined.

The control device 2 is a microcomputer having the usual input and output circuitry. The operation of the control device 2 for determining the injection time t is explained with reference to a flow chart according to FIG. 2.

A program sequence according to this flow chart is executed once for each work cycle for each injection valve of the internal combustion engine 1. In a step S1, the current values for the speed of rotation or rpm n, the suction tube pressure p, the cooling water temperature TKW and the intake air temperature TAL are stored in a main memory of the microcomputer.

In a next step S2, a temperature difference TD is formed from the cooling water temperature TKW and the intake air temperature TAL.

In a step S3, a basic injection time tB is then read out of the basic family of characteristics o characteristic diagram stored in a read-only memory of the control device 2. The suction tube pressure p and the speed of rotation or rpm n are used as input parameters for this purpose.

The values for these basic injection times tB are experimentally determined at a selected intake air temperature TALa and cooling water temperature TKWa. Injection times t are determined for the various load and speed-of-rotation or rpm points under these design conditions, resulting in a fuel-air ratio=1. The injection times t which are thus determined then apply to the design conditions.

The basic injection times tB are then calculated from the injection time t multiplied by the quotient of a respective load-dependently associated corrected intake air temperature TALK and the intake air temperature TALa selected for the design conditions. The mathematical values for the corrected intake air temperature TALK needed during this process are determined experimentally and by calculation. For this purpose, the various load and speed-of-rotation or rpm points are also approached under the design conditions and a fuel-air ratio of=1 is set. During this process, the suction tube pressure p and the air mass LM being taken in are measured in each case. From the thermodynamic state equation, the value of the respective corrected intake air temperature TALK is then obtained as $$TALK = \frac{p \times VZ}{LM \times R}$$

where

VZ is the cylinder volume and

R is the gas constant.

In a step S4 according to FIG. 2, the air mass LM being taken in is then calculated from the basic injection time tB multiplied by the speed of rotation or rpm n.

In a step S5, a correction temperature TK is read out of the family of correction characteristics that is also stored in a read-only memory of the control device 2. The values for the air mass LM and the temperature difference TD determined in the steps S2, S3 and S4 are used as input quantities for this purpose.

These correction temperatures TK are also determined experimentally. For this purpose, the values for the corrected intake air temperature TALK are determined at various temperature differences TD similar to the method previously described for the design conditions. The respective correction temperature TK is then obtained after subtracting the respective intake air temperature TAL which is used as a basis.

The correction temperature TK from the step S5 can then be used, by means of addition with the intake air temperature TAL being measured, for determining the associated corrected intake air temperature TALK which corresponds in good approximation to the temperature of the intake air in the cylinder.

Finally, in a step S7, the injection time t is calculated, according to which the injection valves 10 are then selected. During this process, the basic injection time tB is corrected in accordance with the corrected intake air temperature TALK by multiplying it with the quotient from the intake air temperature value TALa selected for the design conditions an the corrected intake air temperature TALK.

We claim:

1. In a method for controlling an internal combustion engine having cylinders operating in cycles and an intake tube for intake air, which includes determining a fuel mass to be injected into each cylinder for each cycle as a function of operating parameters of the internal combustion engine by reading a basic fuel value out of a basic family of characteristics and correcting the basic fuel value as a function of a temperature of the intake air, and multiplying the basic fuel value by a correction factor FK=A/B, wherein the denominator B is a temperature value, the improvement which comprises:

selecting the variables of the basic family of characteristics as a pressure in the intake tube and an rpm, and reading a correction temperature contained in the temperature value out of a family of temperature characteristics in dependence on a variable dependent on an air flow and of a heating temperature being determinative for heating up the intake air in the intake tube.

2. The method according to claim 1, which comprises determining the heating temperature in the family of temperature characteristics as a temperature difference between the temperature of the intake air and the temperature of cooling water.

3. The method according to claim 1, which comprises determining a measure of the air flow as the product of the rpm of the internal combustion engine and the respective basic fuel value.

4. The method according to claim 1, which comprises determining the family of temperature characteristics by calculating an associated corrected intake air temperature for each interpolation point of the heating temperature and for each interpolation point of the air flow, in accordance with the formula $$TALK = \frac{p \times VZ}{LM \times R}$$

wherein p is the pressure in the intake tube, VZ is the cylinder volume, LM is the air mass per cylinder and stroke and R is a gas constant.

5. The method according to claim 2, which comprises determining the basic family of characteristics for a particular internal combustion engine by initially determining at least one characteristic of the family of temperature characteristics under design conditions, and setting the variables of each interpolation point of the basic family of characteristics under design conditions and varying the associated basic fuel value until the fuel mass supplied to the internal combustion engine has a stoichiometric ratio to the air mass being supplied.

6. The method according to claim 5, which comprises which comprises selecting the design conditions as constant temperatures of the intake air and of the cooling water.

7. In a method for controlling an internal combustion engine having cylinders operating in cycles and an intake tube for intake air, which includes determining a fuel mass to be injected into each cylinder for each cycle as a function of operating parameters of the internal combustion engine by reading a basic fuel value out of a basic family of characteristics and correcting the basic fuel value as a function of a temperature of the intake air, and multiplying the basic fuel value by a correction factor FK=A/B, wherein the denominator B is a temperature value, the improvement of which comprises:

selecting the variables of the basic family of characteristics as a pressure in the intake tube and an rpm, reading a correction temperature contained in the temperature value out of a family of temperature characteristics, and adding the respective temperature of the intake air to the correction temperature read out of the family of temperature characteristics for determining the denominator B in the correction factor FK.

8. A method for controlling an internal combustion engine, which comprises:

selecting variables of a basic family of characteristics as a pressure of intake air in an intake tube and an rpm, determining a fuel mass to be injected into respective cylinders for respective cycles as a function of operating parameters of an internal combustion engine by reading a basic fuel value out of the basic family of characteristics, correcting the basic fuel value by multiplying the basic fuel value by a correction factor FK=A/B, wherein the denominator B is a temperature value, and reading a correction temperature contained in the temperature value out of a family of temperature characteristics in dependence on a variable dependent on an air flow and of a heating temperature being determinative for heating up the intake air in the intake tube.

9. A method for controlling an internal combustion engine having cylinders operating in cycles and an intake tube for intake air, which comprises:

selecting variables of a basic family of characteristics as a pressure of intake air in the intake tube and an rpm of the internal combustion engine;

determining a fuel mass to be injected into respective cylinders for respective cycles as a function of operating parameters of the internal combustion engine by reading a basic fuel value from the basic family of characteristics;

correcting the basic fuel value by multiplying the basic fuel value with a correction factor FK=A/B, wherein the denominator B is a temperature value;

selecting a basic family of correction temperatures in dependence on a variable which is a function of an air mass flow and of a temperature which determines a heating up of the intake air in the intake tube;

reading a correction temperature from the family of correction temperatures; and incorporating the correction temperature in the temperature value of the denominator B for correcting the basic fuel value.

* * * * *